US006941862B2

(12) United States Patent
Weiler

(10) Patent No.: US 6,941,862 B2
(45) Date of Patent: Sep. 13, 2005

(54) FOLDER

(75) Inventor: Gerd Weiler, Kerzenheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 15 days.

(21) Appl. No.: 10/472,751

(22) PCT Filed: Mar. 7, 2002

(86) PCT No.: PCT/DE02/00829

§ 371 (c)(1),
(2), (4) Date: Jan. 20, 2004

(87) PCT Pub. No.: WO02/079065

PCT Pub. Date: Oct. 10, 2002

(65) Prior Publication Data

US 2004/0135303 A1 Jul. 15, 2004

(30) Foreign Application Priority Data

Apr. 2, 2001 (DE) ..... 101 16 346

(51) Int. Cl.[7] ..... B41F 13/56
(52) U.S. Cl. ..... 101/227; 270/5.02
(58) Field of Search ..... 101/226, 227; 271/184, 200, 303; 493/416, 440; 270/5.02, 13, 19, 20.1, 21.1, 47

(56) References Cited

U.S. PATENT DOCUMENTS

| | | | | |
|---|---|---|---|---|
| 974,231 | A | | 11/1910 | Boyce |
| 4,861,326 | A | | 8/1989 | Kuhner et al. |
| 4,921,235 | A | | 5/1990 | Biagiotti et al. |
| 5,064,180 | A | | 11/1991 | Wingate |
| 5,405,126 | A | | 4/1995 | Mack |
| 5,439,206 | A | * | 8/1995 | Raasch et al. ..... 270/8 |
| 5,707,054 | A | | 1/1998 | Loquet et al. |
| 5,901,647 | A | | 5/1999 | Kohlmann |
| 6,000,334 | A | * | 12/1999 | Suzuki ..... 101/227 |
| 6,019,714 | A | | 2/2000 | Stab |
| 6,129,352 | A | | 10/2000 | Stab |
| 6,186,501 | B1 | | 2/2001 | St. Ours |
| 8,367,792 | | * | 4/2002 | Chagnon ..... 270/5.02 |

FOREIGN PATENT DOCUMENTS

| | | |
|---|---|---|
| DE | 1 204 689 | 11/1965 |
| DE | 1 204 689 | 6/1966 |
| DE | 36 26 287 A1 | 2/1988 |
| DE | 195 09 947 A1 | 9/1996 |
| DE | 195 25 169 A1 | 9/1996 |
| DE | 196 10 900 | 12/1996 |
| EP | 0 005 822 A1 | 12/1979 |
| EP | 0 302 031 A1 | 2/1989 |
| EP | 0 451 573 A1 | 10/1991 |
| EP | 0 607 514 A2 | 7/1994 |
| EP | 0 988 970 A2 | 3/2000 |
| WO | WO 97/24284 | 7/1997 |
| WO | WO 98/23517 | 6/1998 |

* cited by examiner

*Primary Examiner*—Ren Yan
(74) *Attorney, Agent, or Firm*—Jones Tullar & Cooper PC

(57) ABSTRACT

A folder includes a cutter for cutting a web of material into signatures, a folding device for producing at least one fold in a signature cut from the web of material, at least one delivery and one conveyor path for directly feeding the cut signatures to the delivery device while avoiding the folding device. The signatures can be guided either by the conveyor path or through the folding device. A signature switch of the conveyor path distributes the signatures to two flies or paddle wheels that deliver to conveyor belt devices that are arranged in parallel to the rotational axes of the paddle wheels.

12 Claims, 3 Drawing Sheets

FOLDER

FIELD OF THE INVENTION

The present invention is directed to a folding apparatus having a cutting device, a folding device and a delivery device. The folding apparatus may also include at least one paddle wheel and a conveying device.

BACKGROUND OF THE INVENTION

A prior folding apparatus is known from WO 97/24284 A2. Such a folding apparatus is arranged, for example, at the outlet of a rotary printing press purpose of this folding apparatus is for cutting an imprinted, possibly longitudinally folded web of material, which can consist of one or several layers, into sections, called signatures, and for cutting these signatures once or several times.

In contrast to the course of material movement followed during a printing process, the folding process requires, particularly in the course of transferring the signature from the folding blade cylinder to the folding jaw cylinder, movements of the signature transversely to its surface, which movements are hampered by the flow resistance of the air. For this reason, during a continuous folding process, in which the freshly imprinted web of material is directly fed to a folding apparatus, the maximum operating speed of the folding apparatus is the one factor which limits the processing speed of the entire production process. A further speed-limiting factor results from the fact that the cylinders of the folding apparatus, with their folding blades and folding jaws, have a multitude of elements which need to be abruptly accelerated and braked during the folding operation and which are therefore subject to wear, which wear increases superproportionally with increasing processing speed.

In order to increase the flexibility of a folding apparatus, which is a part of a continuous production process, and in particular to make possible the production of items with a differing number of folds, it is known to equip the cylinders of a folding apparatus with grippers, which grippers make possible the guiding of the signatures through the apparatus without folding. However, since these grippers also perform a discontinuous movement, they also limit the processing speed of the printing process even if no fold is being created in the folding apparatus. Moreover, these grippers increase the number of elements which are subject to wear, and which therefore require maintenance.

DE 195 26169 A1, DE 195 09 947 A1 and DE 36 26 287 A1 each describe a folding apparatus to which an additional module can be laterally connected. This additional module has a feeding track with a paddle wheel and a belt delivery for conveying signatures which were not transversely folded.

EP 0 451 573 A 1 discloses a folding unit with a conveying track. A signature shunt is provided for the selective conveyance of signatures to two delivery devices. A retardation device for slowing down the signatures is arranged between the signature shunt and the delivery devices.

DE 12 04 689 B shows a folding apparatus with a conveying track for conveying signatures to a paddle wheel, and a conveyor belt device for carrying off signatures. The removal direction of the conveyor belt device extends parallel with the axis of rotation of the paddle wheel.

A folding apparatus with a conveyor track is known from EP 0 005 822 A1. A signature shunt is arranged upstream of two delivery devices. Each of the delivery devices has a paddle wheel, whose axis of rotation extends transversely with respect to the conveying direction of the conveying track.

DE 196 10 900 A1 discloses a folding apparatus with a cutting device, a folding device for transverse folding, a conveying track and at least one delivery device. Two longitudinal formers are arranged upstream of this folding apparatus. A web path leads to the folding device from a longitudinal former. A web path from the other longitudinal former leads to the conveying track.

SUMMARY OF THE INVENTION

The object of the present invention is directed to producing a folding apparatus.

In accordance with the present invention, this object is attained by providing a folding device having a cutting device, a folding device for transverse folding and at least one delivery device. A conveying track is provided for the direct conveyance of cut signatures to a delivery device, while bypassing the folding device. The signatures can be selectively guided over the conveying track or through the folding device. The delivery device has a paddle wheel and a conveyor belt device. The conveyor belt device conveys in a direction which is parallel with an axis of rotation of the paddle wheel. The feeding direction of the conveying device may be arranged transversely to the axis of rotation of the paddle wheel. Signature edge cutters may be assigned to the conveyor belt device.

The advantages to be gained by the present invention lie, in particular, in that, because of the possibility provided by the conveying track of moving the signatures past the folding device, a speed-restricting effect of the folding device on the entire printing process is omitted when no fold is required in the finished product.

Another speed-restricting effect can result from a limited processing speed of a paddle wheel of a connected delivery device. If a finished product is tossed at too high a speed into the compartments of such a paddle wheel and is sharply braked because of this receipt at too high a speed in a paddle wheel compartment, damages to the finished product can result. However, slowing the products prior to their insertion into the paddle wheel is not, or is only possible in a limited way, when the products are fed to the paddle wheel in an essentially gap-free flow, or in a flow stream with only short distances between them. This problem can be overcome because a signature shunt, which is usable for the selective feeding of the signatures to at least two delivery devices, is provided in the conveying track. If each one of these delivery devices receives from the signature shunt only every second, or every other produced signature in an alternating manner, each individual delivery device can operate at a speed that corresponds to half the production rate of the signatures. The distribution of the signature flow to more than two delivery devices permits an increase in the processing speed which processing speed increase is proportional to the number of the delivery devices.

A speed-retarding device, which can be arranged between the signature shunt and each delivery device, can reduce the speed of the signatures up to one half, compared with the track speed at the inlet to the folding apparatus.

In accordance with a particularly preferred embodiment of the present invention, the delivery device or devices in the conveying track is or are equipped with conveyor belt devices, each of which conveys in a conveying direction that is parallel with the direction of the axis of rotation of the paddle wheel. This construction causes a change of the movement direction of the signatures by 90° when the signatures are being deposited on the conveyor belt device. Trimming of the signatures on all sides becomes possible, without corner stations being required for this, which corner stations are expensive and limit the processing speed.

Increased flexibility during processing can be achieved by the folder of the present invention because the folding apparatus has two inlets for the individual or for the simultaneous feeding of partial webs of material, and structures for bringing these partial webs of material together to form the web of material to be processed in the folding apparatus. In this way, it is possible to process in the folding apparatus selectively one web of material alone, which web of material was introduced through the first inlet, one web of material alone, which web of material was introduced through the second inlet, or a web of material that is composed of partial webs of material introduced through both inlets.

Preferably, each one of the inlets is provided with a former for being able to form a longitudinal fold in the partial web of material that is introduced through this inlet.

A further increase in flexibility of operation is achieved by the provision of structure for separating the two partial webs of material again, which makes it possible to feed a first partial web of material to the conveying track, and to feed a second partial web of material to the folding device. In this way, both processing units of the folding apparatus, the conveying track and the folding device, can be fully utilized simultaneously.

It is worth noting that the conveying track and the folding device of the folding apparatus, as discussed above, can each be used for producing identical products. The conveying track and the folding device can be simultaneously operated, and in this way can again increase the processing speed. For this purpose, a longitudinal cutting device for cutting a web of material into a first and a second partial web of material is advantageously placed upstream of the folding apparatus. The first partial web of material typically has twice the width of the second partial web of material and is fed to the folding device longitudinally folded. By conveying this first partial web of material over the conveying track and cutting it into signatures of a defined length, while the second partial web of material in the folding device is cut into signatures of twice the length and is then transversely folded, it is possible to form respectively identical products on the conveying track and the folding device at substantially higher speed.

A particularly compact, low construction can be achieved with the present invention in that the two delivery devices have paddle wheels which each rotate in the opposite direction and which each deliver to oppositely running conveyor belt devices. These conveyor belt devices can be conducted out of the apparatus on different sides of the apparatus, but at the same height. It is furthermore advantageous for a compact construction if the component which comprises the conveying track and the deliver devices assigned to it, has an inlet and a first outlet for the first delivery device in a first end section, and in an oppositely located second end section or area has an outlet for the second delivery device, and wherein the paddle wheel of the first delivery device is substantially arranged in the center of the component. Such an arrangement allows for the positioning of the component substantially congruent above or below a folding device, so that the requirement for placement space is not increased in comparison with a conventional folding apparatus.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
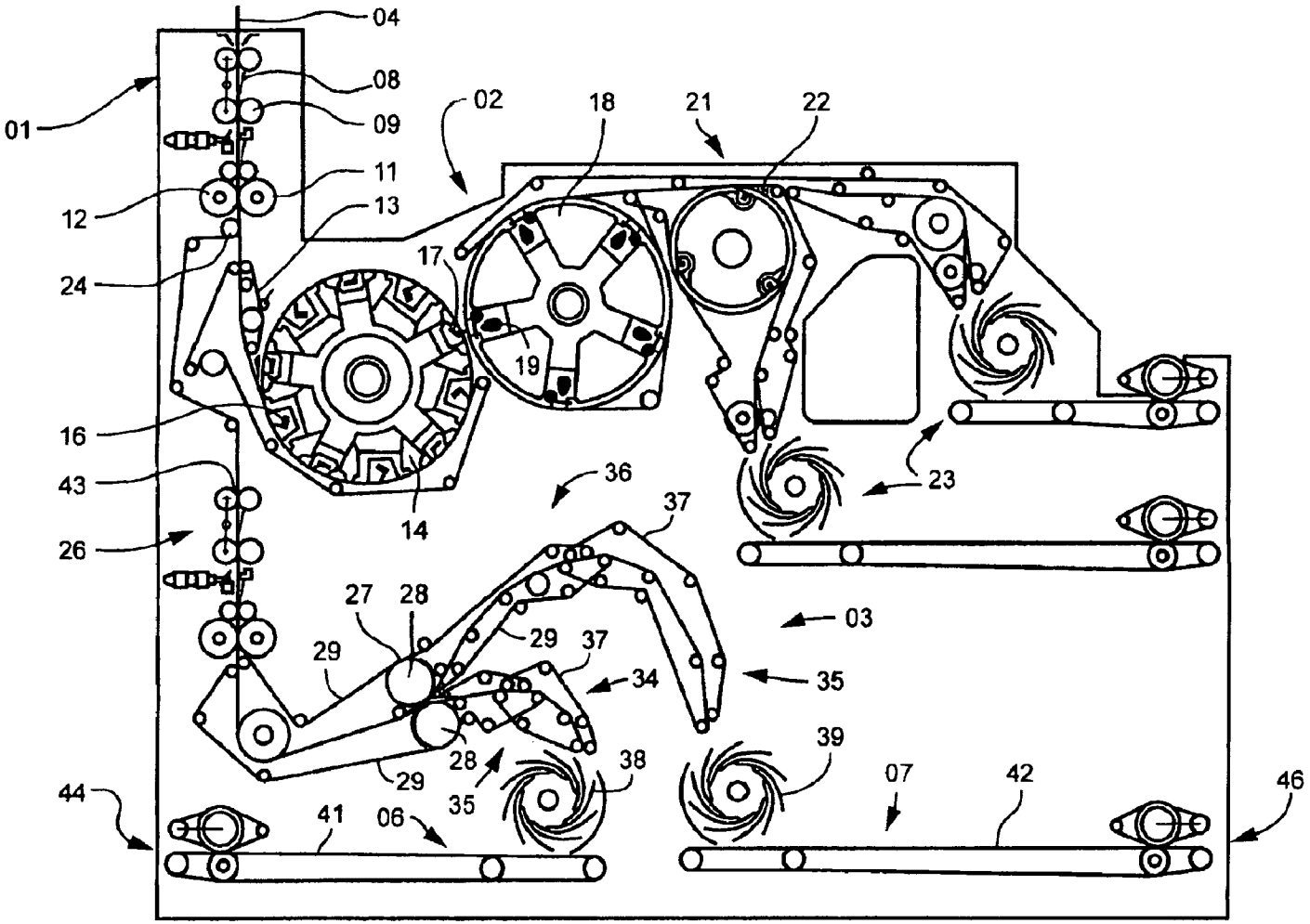
FIG. 1, a schematic side elevation view of a folding apparatus in accordance with a first preferred embodiment of the present invention, FIG. 2, an enlarged portion of the folding apparatus of FIG. 1, and in FIG. 3, a schematic side elevation view of a folding apparatus in accordance with a second preferred embodiment of the present invention.

Referring initially to FIG. 1, there may be seen a first preferred embodiment of a folding apparatus in accordance with the present invention. The folding apparatus represented in FIG. 1 is essentially comprised of three functional groups a first cutting device 01 for cutting a material web 04 into signatures, which material web 04 has been introduced into the apparatus and is possibly longitudinally folded a folding device 02 for folding the cut-to-size signatures received from the cutting device 01; and a conveying track 03, on which the cut-to-size signatures are conveyed directly to delivery devices 06, 07 while bypassing the folding device 02.

The first cutting device 01 comprises a rotating cutter 08 for longitudinally trimming the web of material 04, a traction roller 09 for maintaining a preset tension in the web of material 04, and following this, blade and groove cylinders 11, or 12, which cooperate to cut off a signature from the incoming web of material 04 with each rotation of these cylinders 11 and 12. The diameters of the blade cylinder 11 and groove cylinder 12 are adjustable with this adjustment in cylinder diameters being for adapting the cutting device 01 to the processing of signatures of various lengths.

The severed signatures are guided to a folding blade cylinder 14 by a first conveyor belt device 13. The speed of the first conveyor belt device 13 is matched to the relative phase position between the blade cylinder 11 and the groove cylinder 12, or to that of the associated folding blade cylinder 14, in such a way that a leading edge of each signature guided by the first conveyor belt device 13 encounters a gripper 16 of the folding blade cylinder 14 and is clamped to cylinder 14 by gripper 16. The signature is conveyed to a gap between the folding blade cylinder 14 and a cooperating folding jaw cylinder 18 with the aid of the grippers 16. In this gap, folding blades 17 of the folding blade cylinder 14 are flipped, or extended out and are used for pressing the signature into a folding jaw 19 of the folding jaw cylinder 18. The folded signature is transferred to the folding jaw cylinder 18 by being clamped into the folding jaw 19. The signature is then passed on by the folding jaw cylinder 18 to a second conveyor belt device 21, which distributes the flow of signatures to two delivery devices 23 through a signature shunt 22.

In the first preferred embodiment of the present invention, as represented in FIG. 1, the first cutting device 01 can be deactivated, for example by moving the blade cylinder 11, or the groove cylinder 12 away from the web of material 04. In the conveying direction of the material web 01 downstream of the blade cylinder 11 and groove cylinder 12 there is a branch 24, by which the web of material 04 can be conveyed around, or can bypass the first conveyor belt device 13 and can be fed to a second cutting device 26. The construction of this second cutting device 26 is equivalent to that of the first cutting device 01 and will therefore not be described in detail.

Figure 2:
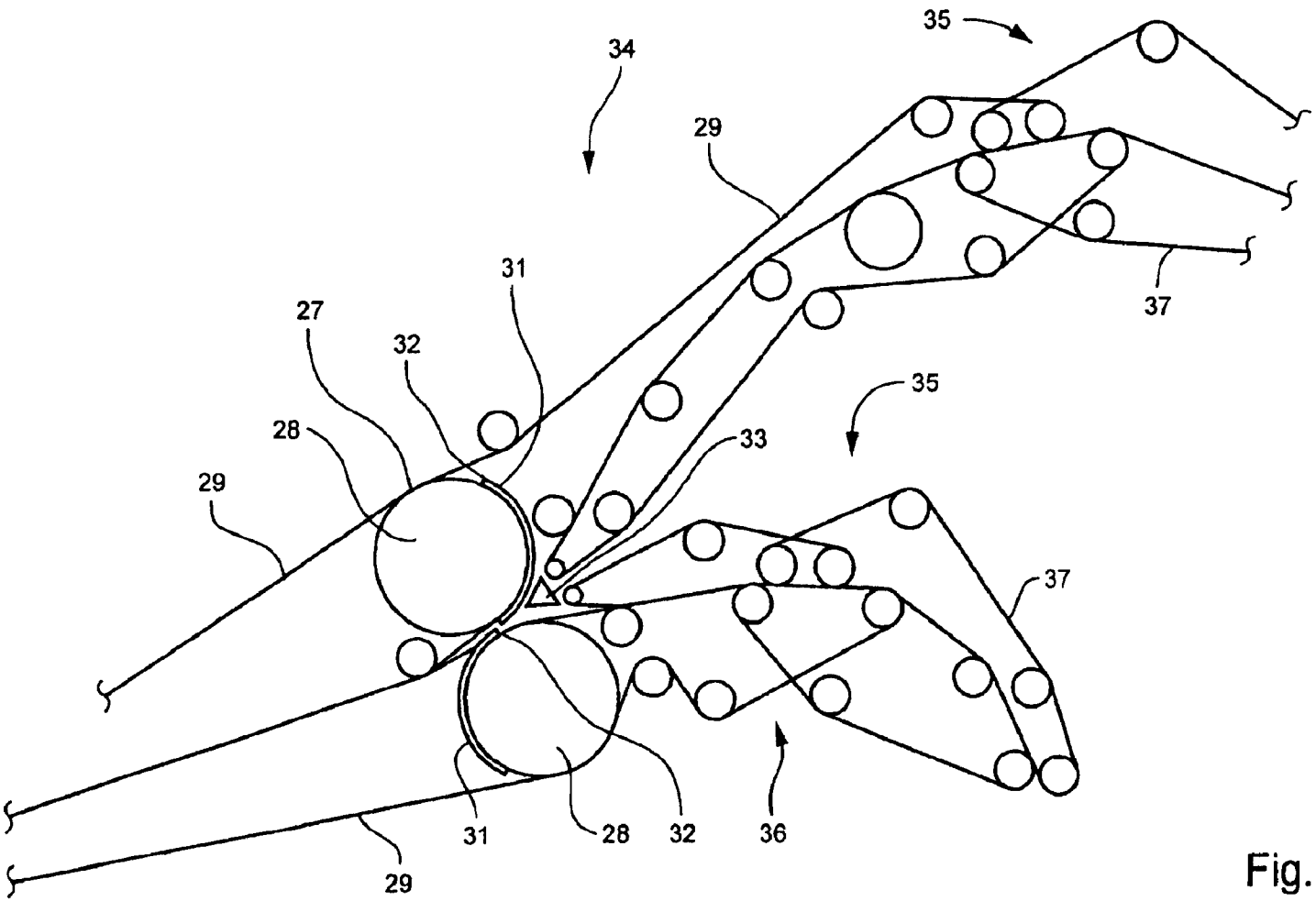

The conveying track 03, which is one of the three functional groups of the folding apparatus, follows the second cutting device 26. Conveying track 03 receives signatures cut from the material web 04 by the second cutting device 26 and initially conveys them to a signature shunt 27. The signature shunt 27 is comprised of two rollers 28, which are placed opposite each other, and around each of which rollers 28 belts 29 of the conveying track 03 are looped. Each of the two rollers 28 has cams 31 which can extend around up to half of each roller's circumference and which cams 31 can be more clearly seen in the enlarged representation of FIG. 2.

The conveying speed of the conveying track 03 in the area of the rollers 28, or the track speed of the belts 29, is selected in such a way that a distance between leading edges 32 of each of the cams 31 corresponds to a distance between leading edges 32 of signatures conveyed on the conveying track 03 in the area of the belts 29. The cams 31 control a back-and-forth movement of a wedge 33, arranged in the outlet nip of the gap between the two rollers 28, between two positions, and in which two positions, the wedge 33 guides the signatures passing through the gap into one of two conveying conduits 34, 36, respectively.

In a first section, the two conveying conduits 34, 36 are defined by belts 29 which are looped around the rollers 28, and whose track speeds accordingly correspond to the circumferential speed of the rollers 28. A retardation device 35 is formed in a second section of each of the conveying conduits 34 or 36 by retardation device belts 37, which move at a reduced speed and which slow the signatures down. The retardation devices 35 can also have several sections, constituted by belts 37 with successively reduced speeds for the stepped or progressive slowing of the signatures.

The conveying conduits 34, 36 each lead to a paddle wheel 38, or 39, as seen in FIG. 1, into whose paddles the conveyed signatures fall. A left paddle wheel 38 is assigned to the conveying conduit 34 and rotates in a clockwise direction. Left paddle wheel 38 makes deposits of signatures on a conveyor belt 41 running toward the left. A right paddle wheel 39 rotates in a counterclockwise direction and makes deposits of signatures on a conveyor belt 42 running toward the right. The speeds of the paddle wheels 38 or 39 and of the conveyor belts 41 or 42 are matched to each other in such a way that, in the area where the deposited signatures touch the conveyor belt 41 or 42, the circumferential speed of the paddle wheel 38, 39 substantially corresponds to the conveying speed of the associated conveyor belt 41 or 42, respectively. Thus, the deposit of the signatures on the conveyor belt 41, 42 is not caused by a traction force of the conveyor belt 41, 42 on the signatures, but is accomplished exclusively by the pushing of a deposit arm, not specifically shown in FIG. 1, which is arranged, fixed in place, on the paddle wheels 38, 39 and which enters into a gap between the paddles so that, when the paddles rotate past the deposit arm, the latter pushes the signatures out of the paddles. In this way an absolutely dependable and evenly fish-scaled or embricated deposit of the signatures is achieved, even at a high operating speed of the paddle wheels 38, 39.

The conveying track 03, and the second cutting device 26 assigned to it, form a modular component, which modular component can be installed underneath a conventional folding apparatus with slight adaptations of the latter, such as the subsequent attachment of the branch 24, without additional placement space being required for this. This installation becomes possible, in particular because of the asymmetric construction of the module. The signatures pass through a conventional folding apparatus in a direction from left to right as seen with respect to FIG. 1. The modular component is matched to this in that the modular component inlet 43 for the material to be processed, in this case the inlet of the second cutting device 26, is arranged in a first end area of the component, the left end area in FIG. 1, and that both paddle wheels 38, 39 are located offset, in relation to this modular component inlet 43, in the direction toward the other end area, the direction toward the right in FIG. 2. Thus, in the same way as with the folding apparatus, no placement space is required to the left of the modular component inlet 43. Moreover, the arrangement of the two paddle wheels 38, 39 rotating in opposite directions allows for the removal of the products in two directions, through outlets 44, 46 on one level, so that only little structural height is required.

In principle, a space-saving arrangement would also be possible, in which the component of the conveying track 03 could be mounted above that of the folding device 02. However, the previously described arrangement, as represented in FIG. 1, is preferred, because the folding device 02, which requires a greater amount of maintenance and more adjustment outlay than the conveying track 02, is more easily accessible in the configuration depicted in FIG. 1.

In the first preferred embodiment described above, the second cutting device 26, which is part of the modular component, has been arranged upstream of the conveying track 03 in order to achieve simple retrofitting of an existing folding apparatus by inclusion of the conveying track 03 and the two delivery devices 06, 07.

It is, of course, also possible to integrate the two functions of the folding apparatus, cutting and folding, more closely with each other in that only one cutting device may be provided and a signature shunt is provided at the outlet of this one cutting device, which signature shunt allows it to convey the cut signatures selectively either to the folding device or to the conveying track.

Whenever the conveying track 03 is operating, the folding device 02 can be completely shut off. This leads to a reduced power consumption of the folding apparatus. Wear of the sensitive parts of the folding apparatus is also reduced as well. Furthermore, the folding apparatus can be operated at a higher speed than would be possible if the folding device 02 were also being operated.

Figure 3:
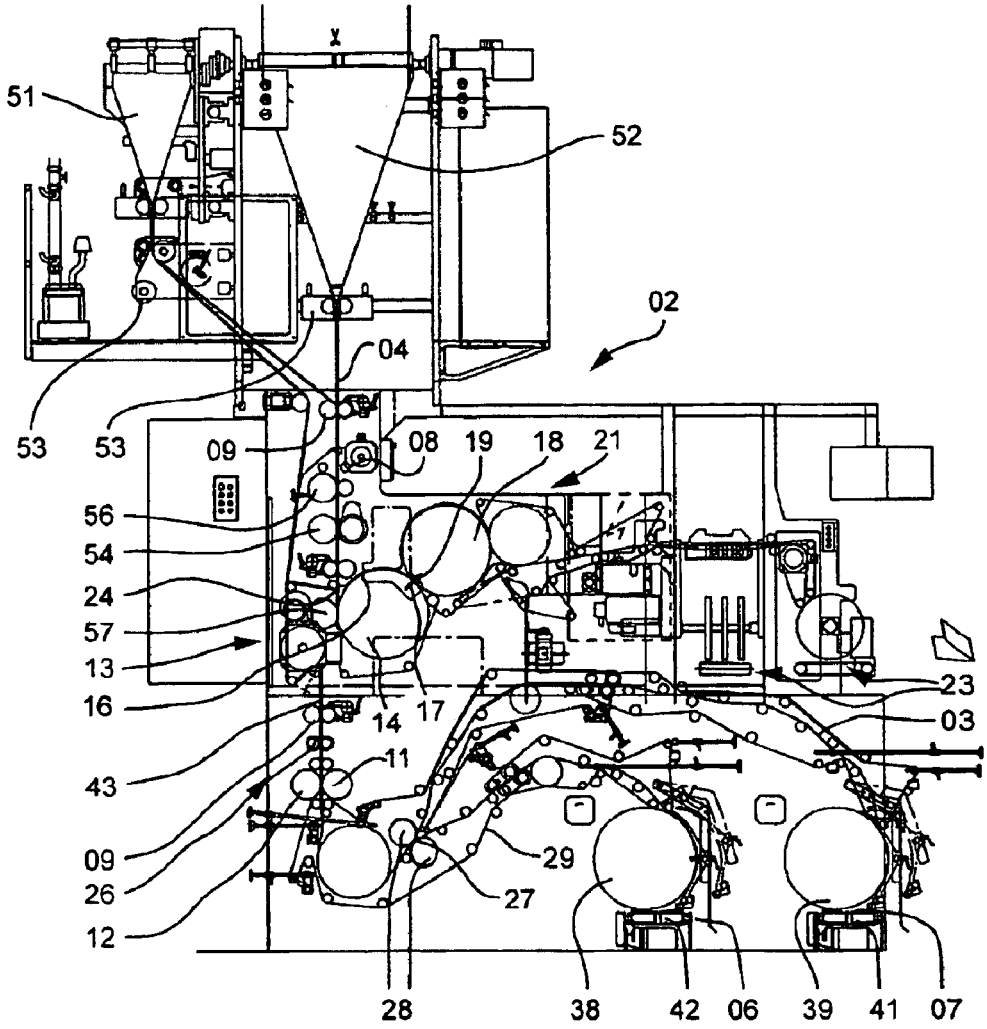

FIG. 3 shows a side elevation view of a second preferred embodiment of a folding apparatus, generally analogous to FIG. 1, in accordance with the present invention. Elements, whose structure and function correspond to the elements already described in relation with FIGS. 1 and 2, have the same reference symbols.

This second preferred embodiment of a folding apparatus has two inlets which are in the form of two formers 51, 52. The web of material 04 to be processed can be supplied selectively via one of these two formers 51, 52. The web of material 04 can also be formed only inside the folding apparatus in that partial webs of material, simultaneously conveyed via the two formers 51, 52 are deflected by rollers 53 and are placed on top of each other to form the web of material 04.

Subsequently, the web of material 04 passes over a traction roller 09 and a cutter 08 for longitudinal trimming. Transverse and longitudinal perforating units 54, 56 for the transverse and longitudinal perforation of the web of material 04 are arranged following the cutter 08 and upstream of a second traction roller 09.

There are two paths along which the web of material 04 can be further conveyed after the second traction roller 09. The first is toward the folding device 02. The second is toward the conveying track 03. If the web of material 04 is composed of two partial webs which have been fed through the two formers 51, 52, respectively, both partial webs can be conveyed either to the folding device 02 or to the conveying track 03, or the web of material 04 can again be divided into the two partial webs. The partial web supplied through the former 51 is further conveyed to the conveying track 03. The partial web supplied via the former 52, however, is conveyed to the folding device 02.

In this second preferred embodiment, an inlet to the folding device 02 is constituted by a gap between a blade cylinder 57 and the folding blade cylinder 14. At its inlet 34, the conveying track 03 has, as was previously described with respect to FIG. 1, a second cutting device 26 for dividing the supplied web of material into signatures. The length of these signatures is not necessarily the same as that of the ones cut by the blade cylinder 57, in particular, the length of those signatures can be half as long or less than the latter. The structure of the conveying track 03 following the cutting device 26 corresponds to a great extent to the one described in connection with FIGS. 1 and 2. However, a first difference is that in the second embodiment, as shown in FIG. 3, the paddle wheels 38, 39 rotate in the same direction. A second important difference is that the conveyor belts 41, 42 on which the paddle wheels 38, 39 deposit their signatures, are oriented in a direction extending parallel with the axes of rotation of the paddle wheels 38, 39 convey in a direction perpendicular in relation to the plane of the drawing in FIG. 3. The conveying direction is the same for both conveyor belts 41, 42 and has been selected in such a way that the signatures, to the extent that they have a longitudinal fold which was formed in the former 51 or 52, are conveyed out with that longitudinal fold at the front.

By the change of the conveying direction of the signatures out of the plane in FIG. 3, in a direction perpendicular in respect to this plane, it is possible, with the aid of cutters which are not specifically represented in the drawing, to trim the tops and bottoms of the signatures that are conveyed out on the conveying belts 41, 42, without corner stations being required for this, in which corner stations the signatures are respectively slowed down and turned by 90° for aligning their trimmed edges in the conveying direction.

As can be seen, the folding apparatus in FIG. 3 also permits the processing of a fed-in web of material into a multitude of different product formats. A particular advantage of this second preferred embodiment of a folding apparatus is the possibility of producing identical products by the simultaneous operation of the folding device 02 and the conveying track 03 through respectively different intermediate steps, and in this way to achieve a very high processing speed for these products. To make use of this functionality, a web of material, such as an imprinted paper web, is cut into three partial webs whose widths are identical with each other in a longitudinal cutting apparatus, which is known per se and which is therefore not represented in FIG. 3, and which longitudinal cutting apparatus is arranged upstream of the folding apparatus. Two partial webs are conveyed on top of each other to the folding apparatus via the former 51, forming a partial web with a longitudinal fold. The other or third partial web is conveyed without a longitudinal fold via the former 52. At the level of the second traction roller 09, the now two partial webs are separated again. The wider partial web, which was the original third web without a longitudinal fold, is conveyed to the folding device 02. It is cut into signatures of a defined length and the signatures are folded once transversely, and longitudinally in the third fold in order to obtain a product of half the length of the signatures. The two original partial webs, which were placed on top of each other, are conveyed to the conveying track 03, at whose inlet they are directly cut into signatures of the same half length. The signatures obtained in this way are distributed by use of the signature shunt 27 to the two conveyor belts 41, 42. In this way, the folding apparatus produces three signatures in each work cycle of the folding device 02.

At least two longitudinal formers 51, 52 are arranged upstream of the folding apparatus, as depicted in FIG. 3. A first web path is provided from the one longitudinal former 52 to the folding device 02. A second web path is provided from the other longitudinal former 51 to the conveying track 03. The second web path runs independently of the first web path.

While preferred embodiments of a folder in accordance with the present invention have been set forth fully and completely hereinabove, it will be apparent to one of skill in the art that various changes in, for example, the type of web being folded, the type of printing press used to print the web, and the like could be made without departing from the true spirit and scope of the present invention which is accordingly to be limited only by the following claims.

What is claimed is:

1. A folding apparatus comprising:

a cutting device adapted to cut a web into a plurality of signatures;

a folding device usable to transversely fold signatures received from said cutting device;

a plurality of delivery devices adapted to receive signatures;

a conveying track usable to convey cut signatures to first and second ones of said plurality of delivery devices while bypassing said folding device;

a signature shunt in said conveying track usable for the selective delivery of cut signatures to said first and second delivery devices;

first and second paddle wheels associated with said first and second delivery devices, each of said first and second paddle wheels having an axis of rotation; and first and second conveyor belt devices in said first and second delivery devices and associated with said first and second paddle wheels and each having a conveying direction, said conveyor belt conveying directions of said first and second conveyor belt devices being parallel with said axes of rotation of said associated first and second paddle wheels.

2. The folding apparatus of claim 1 wherein at least one of said plurality of delivery devices is assigned to said folding device.

3. The folding apparatus of claim 1 further including a signature retardation device between said signature shunt and each of said first and second delivery devices.

4. The folding apparatus of claim 1 wherein said first and second paddle wheels have opposing directions of rotation and further wherein said conveying directions of said first and second conveyor belt devices are opposite to each other.

5. The folding apparatus of claim 1 wherein said conveying track and said plurality of delivery devices assigned to it form a modular component.

6. The folding apparatus of claim 5 wherein said modular component is located underneath said folding device.

7. The folding apparatus of claim 1 further including at least first and second inlets usable to introduce partial webs into said folding apparatus, and means for associating said partial webs of material to form a web of material.

8. The folding apparatus of claim 7 wherein at least one of said at least first and second inlets is equipped with a former.

9. The folding apparatus of claim 7 further including means for separating said associated partial webs of material and for conveying a first one of said partial webs of material to said conveying track and for conveying a second one of said partial webs of material to said folding device.

10. The folding apparatus of claim 1 further including a longitudinal cutting device arranged upstream, in a direction of web travel, of said folding device.

11. The folding apparatus of claim 1 further including a first cutting device assigned to said folding device and a second cutting device assigned to said conveying track.

12. The folding apparatus of claim 1 further including means for selectively switching off one of said folding device and said conveying track when said signatures are selectively guided to the other of said folding device and said conveying track.

* * * * *